US008500201B2

(12) United States Patent
Teng

(10) Patent No.: US 8,500,201 B2
(45) Date of Patent: Aug. 6, 2013

(54) ELECTROMAGNETIC ROCKING CHAIR

(75) Inventor: Mei-Sheng Teng, ShenZhen (CN)

(73) Assignee: Hui Mei Baby Products Ltd., Shenzhen (CN)

( * ) Notice: Subject to any disclaimer, the term of this patent is extended or adjusted under 35 U.S.C. 154(b) by 266 days.

(21) Appl. No.: 12/871,907

(22) Filed: Aug. 31, 2010

(65) Prior Publication Data

US 2012/0052963 A1 Mar. 1, 2012

(51) Int. Cl.
*A47D 13/10* (2006.01)
*A63G 9/16* (2006.01)

(52) U.S. Cl.
USPC ..... 297/273; 297/281; 472/119

(58) Field of Classification Search
USPC ..... 297/273, 277, 281, 262.1, 262.2, 297/260.1, 26.2; 472/119
See application file for complete search history.

(56) References Cited

U.S. PATENT DOCUMENTS

| | | | | |
|---|---|---|---|---|
| 3,842,450 | A * | 10/1974 | Pad | 5/109 |
| 3,883,136 | A * | 5/1975 | Kim | 472/119 |
| 5,833,545 | A * | 11/1998 | Pinch et al. | 472/119 |
| 6,692,368 | B1 * | 2/2004 | Hyun | 472/119 |
| 2002/0140263 | A1 * | 10/2002 | Sato et al. | 297/260.1 |
| 2007/0111809 | A1 * | 5/2007 | Bellows et al. | 472/118 |
| 2007/0262627 | A1 * | 11/2007 | Clapper et al. | 297/260.2 |
| 2007/0267904 | A1 * | 11/2007 | Clapper et al. | 297/256.16 |
| 2008/0217974 | A1 * | 9/2008 | Velderman et al. | 297/256.16 |
| 2009/0170618 | A1 * | 7/2009 | Bellows et al. | 472/119 |
| 2010/0151951 | A1 * | 6/2010 | Gilbert et al. | 472/119 |
| 2010/0201171 | A1 * | 8/2010 | Velderman et al. | 297/260.2 |
| 2013/0026805 | A1 * | 1/2013 | Sclare et al. | 297/260.2 |

FOREIGN PATENT DOCUMENTS

| | | | |
|---|---|---|---|
| CN | 201434989 | * | 3/2010 |
| GB | 2218572 | * | 11/1989 |
| JP | 2002345606 A | * | 12/2002 |
| WO | WO 2007013770 | * | 2/2007 |

* cited by examiner

*Primary Examiner* — David E Allred

(57) ABSTRACT

As shown in FIGS. 1-3, the permanent magnet 8 is fixed on the one of the suspension rods 9 and located between the two coils 6 of the two electromagnets 1. To make the chair seat 12 which is originally at rest rock, the electromagnetic rocking chair will be powered on first, and then a rocking button on the control panel (not shown) will be pressed down. After that, the wires a, b will alternately produce higher and lower electric levels (triodes Q1, Q2, Q3 and Q4, Q5, Q6 work alternately) to produce an alternately changing magnetic field within the coils 6 of the electromagnet 1, and the alternately changing magnetic field will push and pull the permanent magnet 8, making the chair seat 12 move back and forth. When the chair seat 12 rocks to a predetermined check point, the corresponding displacement sensor 3 will send a signal to the control circuit provided on the circuit board 2, at this moment, the control circuit provided on the circuit board 2 will change the mode of supplying power to the wires a, b, making the wires a, b produce a constant electric level instead of the previous alternate electric level. Therefore, the coils 6 of the electromagnet 1 will produce a constant magnetic field to keep pushing and pulling the permanent magnet 8, thus gradually adding force to the chair seat 12 to make the chair seat 12 have greater amplitude and ensure the chair seat 12 to swing more freely.

4 Claims, 4 Drawing Sheets

ELECTROMAGNETIC ROCKING CHAIR

BACKGROUND OF THE INVENTION

1. Field of the Invention

The present invention relates to a rocking chair; and more particularly to an electromagnetic rocking chair.

2. Description of the Prior Art

Conventionally, an electric rocking chair utilizes a transmission mechanism (essentially including motor/gears/transmission rods, and etc) to drive the suspension parts of the chair so as to make the chair rock back and forth. However, such a structure suffers from the drawbacks of complicated structure and large noise.

The present invention has arisen to mitigate and/or obviate the afore-described disadvantages.

SUMMARY OF THE INVENTION

The primary objective of the present invention is to provide an electromagnetic rocking chair which utilizes an interaction force between a changing magnetic field on the base and a fixed magnetic field on a bottom of the chair seat to make the chair seat rock back and forth around a suspension point.

To achieve the above objective, an electromagnetic rocking chair in accordance with the present invention comprises a base, a chair seat, two fixed rods, and two suspension rods. Each of the fixed rods has a lower end fixed on one end of the base, and a transverse shaft is fixed on both upper ends of the fixed rods. An upper end of the respective suspension rods is pivotally connected to the transverse shaft, and the chair seat is fixed at a lower end of the respective suspension rods. A permanent magnet is disposed at the lower end of one of the suspension rods, and under the permanent magnet are disposed two electromagnets. The two electromagnets are both fixed on the base and connected to a control circuit provided on a circuit board.

Furthermore, the chair seat is disposed between the two suspension rods, and on the base are further fixed two displacement sensors. The two displacement sensors are located under the respective suspension rods for sensing the displacement of the chair seat, and each of the electromagnets is wound with a coil. The displacement sensors and the coils of the two electromagnets are respectively connected to the control circuit provided on the circuit board.

Two bearing seats are mounted on the transverse shaft adjacent to the respective fixed rods and each are provided with a bearing, the transverse shaft is fixed in the respective bearings.

The control circuit provided on the circuit board includes a control chip U3. A pin A of the control chip U3 is connected to a power source through a resistor R7, a diode D2, a resistor R6, and a pin B of the control chip U3 is connected to the power source through a resistor R9 and connected to the ground through a switch SW1. Between pins I, J of the control chip U3 is cross connected a crystal oscillator Y1, and a pin AB of the control chip U3 is connected to a base of a triode Q1 through a resistor R16. An emitter of the triode Q1 is connected to a base of a triode Q3, and a collector of the triode Q1 is connected to a base of a triode Q2 through a resistor R17. A pin AC of the control chip U3 is connected to a base of a triode Q4 through a resistor R19. A collector of the triode Q4 is connected to a base of a triode Q5 through a resistor R20, and an emitter of the triode Q4 is connected to a base of a triode Q6. A collector of the triode Q6 is connected to an emitter of the triode Q7, and a connector of the triode Q5 is connected to a connector of the triode Q8. The collector of the triode Q2 is further connected to a collector of the triode Q3 through a capacitor C12, and a coil L1. Between the emitter of the triode Q2 and the collector of the triode Q3 are cross connected diodes D3, D4, D5, D6.

The fixed rods are angularly connected to the respective suspension rods.

The electromagnetic rocking chair in accordance with the present invention has the advantages of simple and reasonable structure design, stable running, no noise, adjusting rocking amplitude and the like.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
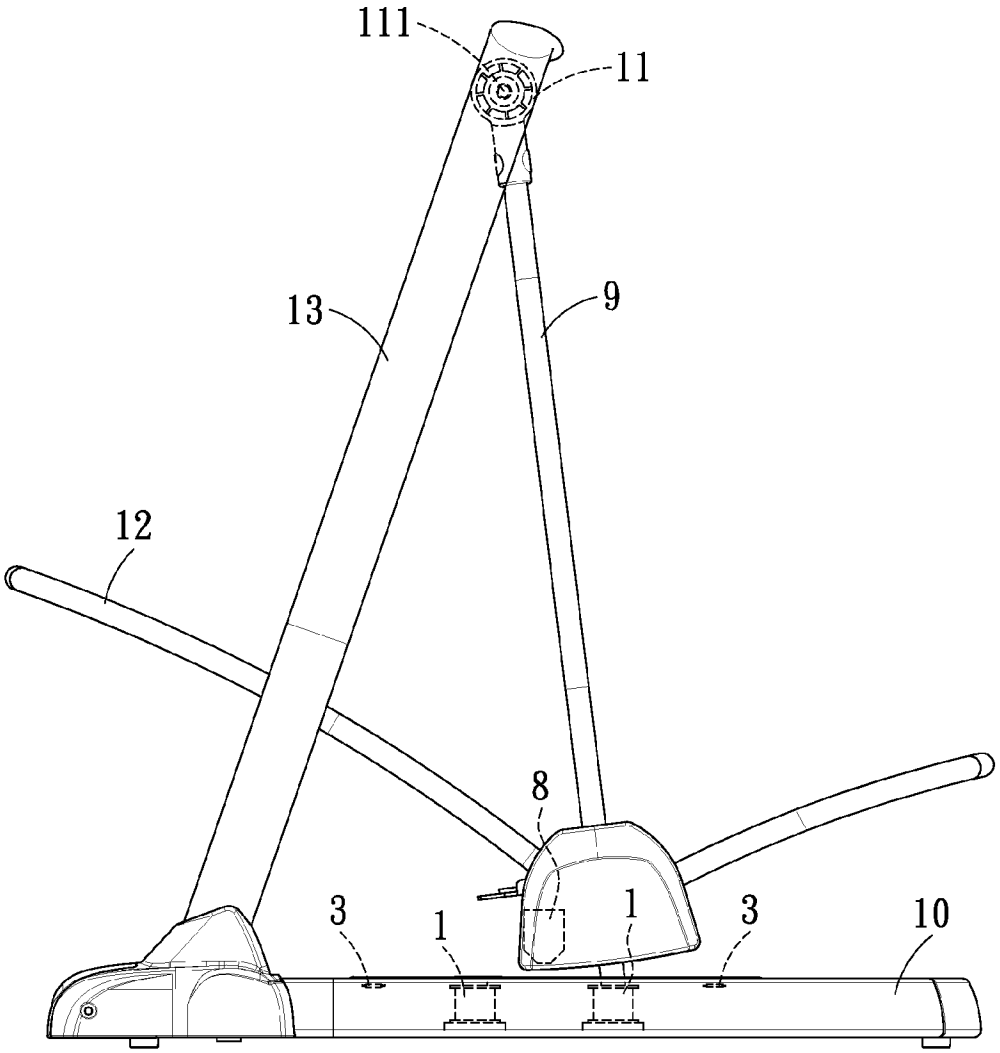
FIG. 1 is a front view of an electromagnetic rocking chair in accordance with the present invention.
Figure 2:
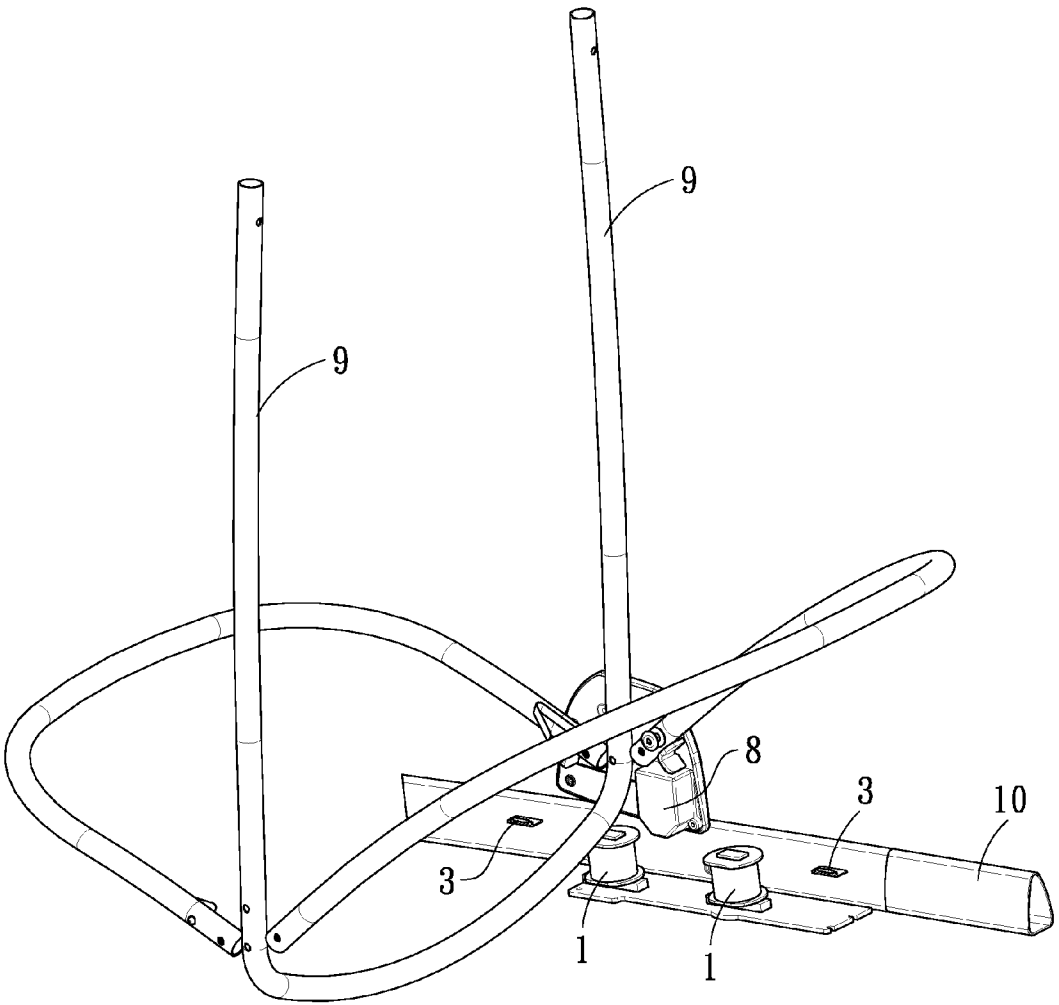
FIG. 2 is a perspective view of FIG. 1.

Referring to FIGS. 1-2, an electromagnetic rocking chair in accordance with the present invention comprises two electromagnets 1, two displacement sensors 3, a permanent magnet 8, two suspension rods 9, a base 10, two bearing seats 11, a chair seat 12, and two fixed rods 13.

The base 10 has one end fixed to a lower end of each of the fixed rods 13 which are obliquely located. A transverse shaft 111 has both ends mounted at upper ends of the fixed rods 13, and two bearing seats 11 are mounted on the transverse shaft 111 adjacent to the respective fixed rods 13. Each of the bearing seats 11 is provided with a bearing, and the transverse shaft 111 is fixed in the bearings. An upper end of each of the suspension rods 9 is connected to the bearing seat 11. The fixed rods 13 are angularly connected to the respective suspension rods 9, as shown in FIG. 1. The two displacement sensors 3 are fixed on the base 10 under the respective suspension rods 9 to sense the displacement of the chair seat 12. The chair seat 12 is fixed between the two suspension rods 9. The respective displacement sensors 3 are connected to a control circuit provided on the circuit board 2. The permanent magnet 8 is disposed at a lower end of one of the suspension rods 9. The two electromagnets 1 are spaced from each other and disposed under the permanent magnet 8. The two electromagnets 1 are fixed on the base 10 and each are wound with a coil 6 which is connected to the control circuit provided on the circuit board 2 through wires 7 (*a, b*).

Figure 4:
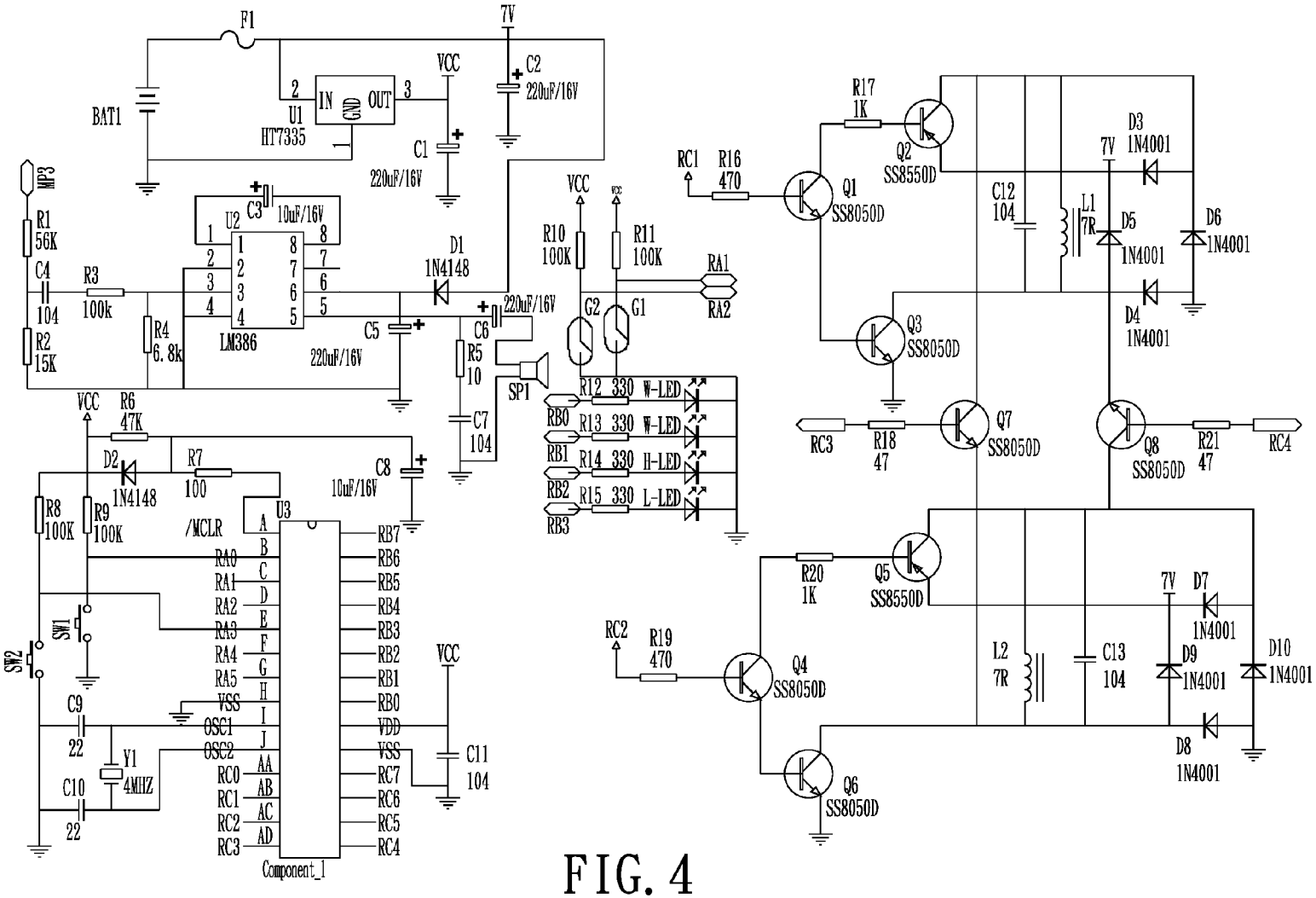
FIG. 4 is a circuit diagram of FIG. 1.

As shown in FIG. 4, the control circuit provided on the circuit board 2 includes a control chip U3. A pin A of the control chip U3 is connected to a power source through a resistor R7, a diode D2, a resistor R6, and a pin B of the control chip U3 is connected to the power source through a resistor R9 and connected to the ground through a switch SW1. Between pins I, J of the control chip U3 is cross connected a crystal oscillator Y1, and a pin AB of the control chip U3 is connected to a base of a triode Q1 through a resistor R16. An emitter of the triode Q1 is connected to a base of a triode Q3, and a collector of the triode Q1 is connected to a base of a triode Q2 through a resistor R17. A pin AC of the control chip U3 is connected to a base of a triode Q4 through a resistor R19. A collector of the triode Q4 is connected to a base of a triode Q5 through a resistor R20, and an emitter of the triode Q4 is connected to a base of a triode Q6. A collector of the triode Q6 is connected to an emitter of the triode Q7, and a connector of the triode Q5 is connected to a connector of the triode Q8. The collector of the triode Q2 is further connected to a collector of the triode Q3 through a capacitor C12, and a coil L1. Between the emitter of the triode Q2 and the collector of the triode Q3 are cross connected diodes D3, D4, D5, D6.

Figure 3:
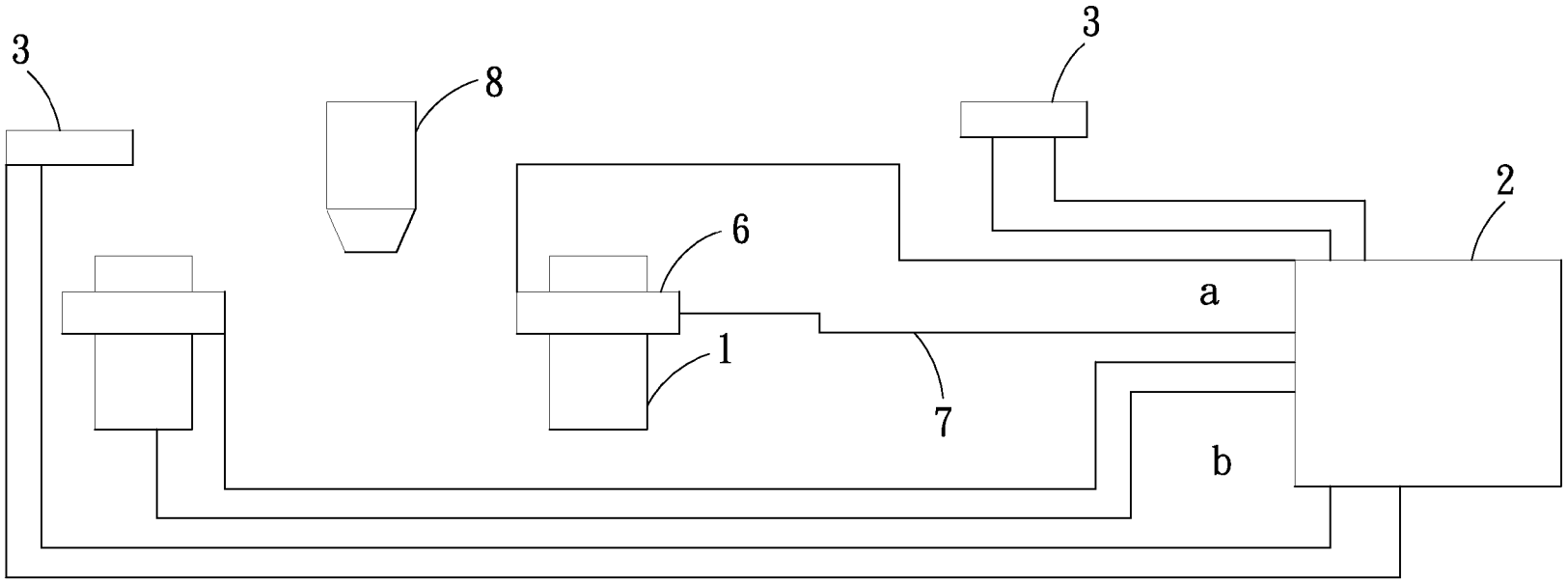
FIG. 3 is a working principle diagram of FIG. 1.

Working Principle:

As shown in FIGS. 1-3, the permanent magnet 8 is fixed on the one of the suspension rods 9 and located between the two coils 6 of the two electromagnets 1. To make the chair seat 12 which is originally at rest rock, the electromagnetic rocking chair will be powered on first, and then a rocking button on the control panel (not shown) will be pressed down. After that, the wires a, b will alternately produce higher and lower electric levels (triodes Q1, Q2, Q3 and Q4, Q5, Q6 work alternately) to produce an alternately changing magnetic field within the coils 6 of the electromagnet 1, and the alternately changing magnetic field will push and pull the permanent magnet 8, making the chair seat 12 move back and forth. When the chair seat 12 rocks to a predetermined check point, the corresponding displacement sensor 3 will send a signal to the control circuit provided on the circuit board 2, at this moment, the control circuit provided on the circuit board 2 will change the mode of supplying power to the wires a, b, making the wires a, b produce a constant electric level instead of the previous alternate electric level. Therefore, the coils 6 of the electromagnet 1 will produce a constant magnetic field to keep pushing and pulling the permanent magnet 8, thus gradually adding force to the chair seat 12 to make the chair seat 12 with greater amplitude and ease.

The control panel further includes rock position buttons for adjusting the amplitude of rock.

While we have shown and described various embodiments in accordance with the present invention, it is clear to those skilled in the art that further embodiments may be made without departing from the scope of the present invention.

What is claimed is:

1. An electromagnetic rocking chair comprising a base, a chair seat, two fixed rods, and two suspension rods, wherein each of the fixed rods has a lower end fixed on one end of the base, and a transverse shaft is fixed on both upper ends of the fixed rods, an upper end of the respective suspension rods is pivotally connected to the transverse shaft, the chair seat is fixed at a lower end of the respective suspension rods, a permanent magnet is disposed at the lower end of one of the suspension rods, under the permanent magnet are disposed two electromagnets, the two electromagnets are both fixed on the base and connected to a control circuit provided on a circuit board, the two suspension rods are driven by magnetic force to make the chair seat rock back and forth, wherein the control circuit provided on the circuit board includes a control chip U3, a pin A of the control chip U3 is connected to a power source through a resistor R7, a diode D2, and a resistor R6, a pin B of the control chip U3 is connected to the power source through a resistor R9 and connected to the ground through a switch SW1, between pins I, J of the control chip U3 is cross connected a crystal oscillator Y1, a pin AB of the control chip U3 is connected to a base of a triode Q1 through a resistor R16, an emitter of the triode Q1 is connected to a base of a triode Q3, a collector of the triode Q1 is connected to a base of a triode Q2 through a resistor R17, a pin AC of the control chip U3 is connected to a base of a triode Q4 through a resistor R19, a collector of the triode Q4 is connected to a base of a triode Q5 through a resistor R20, an emitter of the triode Q4 is connected to a base of a triode Q6, a collector of the triode Q6 is connected to an emitter of the triode Q7, a connector of the triode Q5 is connected to a connector of the triode Q8, the collector of the triode Q2 is further connected to a collector of the triode Q3 through a capacitor C12, and a coil L1, between the emitter of the triode Q2 and the collector of the triode Q3 are cross connected diodes D3, D4, D5, D6.

2. The electromagnetic rocking chair as claimed in claim 1, wherein the chair seat is disposed between the two suspension rods, on the base are further fixed two displacement sensors, the two displacement sensors are located under the respective suspension rods, each of the electromagnets is wound with a coil, the displacement sensors and the coils of the two electromagnets are respectively connected to the control circuit provided on the circuit board.

3. The electromagnetic rocking chair as claimed in claim 1, wherein two bearing seats are mounted on the transverse shaft adjacent to the respective fixed rods and each is provided with a bearing, the transverse shaft is fixed in the respective bearings.

4. The electromagnetic rocking chair as claimed in claim 1, wherein the fixed rods are angularly connected to the respective suspension rods.

* * * * *